US007575211B2

(12) United States Patent
Andritter

(10) Patent No.: US 7,575,211 B2
(45) Date of Patent: Aug. 18, 2009

(54) FIXING MEANS FOR AN OIL COOLER

(75) Inventor: Dirk Andritter, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 205 days.

(21) Appl. No.: 10/564,787

(22) PCT Filed: Jul. 13, 2004

(86) PCT No.: PCT/EP2004/007726

§ 371 (c)(1),
(2), (4) Date: Jan. 17, 2006

(87) PCT Pub. No.: WO2005/012821

PCT Pub. Date: Feb. 10, 2005

(65) Prior Publication Data

US 2007/0074848 A1 Apr. 5, 2007

(30) Foreign Application Priority Data

Jul. 18, 2003 (DE) ..... 103 33 000

(51) Int. Cl.
*F24H 9/06* (2006.01)

(52) U.S. Cl. ..... 248/232; 248/231.81; 180/68.4

(58) Field of Classification Search ..... 248/228.7, 248/230.7, 231.81, 234, 316.7, 232, 233; 165/67, 68; 180/68.4, 68.5
See application file for complete search history.

(56) References Cited

U.S. PATENT DOCUMENTS

| | | | | |
|---|---|---|---|---|
| 2,863,202 | A * | 12/1958 | Hanna | 248/300 |
| 4,362,284 | A * | 12/1982 | Bolante | 248/228.7 |
| 5,205,349 | A * | 4/1993 | Nagao et al. | 165/67 |
| 5,407,161 | A * | 4/1995 | Mulkeran | 248/232 |
| 5,632,332 | A * | 5/1997 | Hanafusa | 165/178 |
| 6,059,019 | A | 5/2000 | Brost et al. | |
| 6,254,161 | B1 | 7/2001 | Wochaski | |
| 6,901,992 | B2 * | 6/2005 | Kent et al. | 165/67 |
| 7,117,927 | B2 * | 10/2006 | Kent et al. | 165/67 |
| 2001/0004010 | A1 | 6/2001 | Halm | |

FOREIGN PATENT DOCUMENTS

| | | |
|---|---|---|
| DE | 197 47 887 A1 | 5/1999 |
| EP | 1 291 204 A1 | 3/2003 |
| GB | 2 373 571 A | 9/2002 |

* cited by examiner

*Primary Examiner*—A. Joseph Wujciak, III
(74) *Attorney, Agent, or Firm*—Foley & Lardner LLP

(57) ABSTRACT

The invention relates to a fixing means for an oil cooler (18) that is fixed in an oil cooler receiving element (10). According to the invention, said fixing means has a latch connection between the oil cooler receiving element (10) and the oil cooler (18). The use of a latch connection is advantageous because it can be easily produced during assembly of the oil cooler.

16 Claims, 2 Drawing Sheets

FIXING MEANS FOR AN OIL COOLER

Oil coolers are fixed at least indirectly to the vehicle frame by means of a fixing means. In most cases, this takes place by the oil cooler being arranged below, in front of or behind another cooler and moreover being supported thereon-via fixing means.

Particularly in their main direction of extent, oil coolers have linear expansion which, due to the not inconsiderable differences in temperature between operating temperature and ambient temperature in the case of the fixing, cannot be ignored. In addition, the oil cooler, due to its mass and the gear oil flowing to it under pressure, is also subjected to considerable acceleration forces and moments which have to be absorbed by appropriate fixing means.

It has therefore previously been customary to provide, in the region of the oil cooler, a screw hole which passes-through the oil cooler and through which a screw bolt can be guided. The screw connection constitutes a secure mounting of the oil cooler on a fixing means, but has the disadvantage of being awkward to fit. However, complicated fixings of this type are considered necessary for securely holding the oil cooler in the driving mode. Fixing elements and receiving elements are produced from metallic materials in order to make a suitable stability unload possible, these materials having the disadvantage of being heavy.

It is therefore the object of the invention to provide a fixing means for an oil cooler that can be produced and fitted in a simple and cost-effective manner.

This object is achieved by a fixing means according to the invention.

According to the invention, a fixing means for an oil cooler which is fixed in an oil cooler receiving element has a latching connection between oil cooler receiving element and oil cooler. The use of a latching connection is advantageous because it can be produced in a particularly simple manner during the installation of the oil cooler. A particularly favorable form of latching connection are clip connections, with use preferably being made of a clip connection which is releasable in a non-destructive manner. In this case, a clip connection is in particular a connection, in which a retaining element is secured, on the one hand, on a component in order to fix a functional element and, on the other hand, engages behind the functional element, in particular in an interlocking or interlocking and frictional manner. In the context of the application, this involves fixing an oil cooler because this is the preferred use. In principle, another additional cooler which is to be arranged in the vehicle may be involved in place of the oil cooler.

According to a preferred refinement of the invention, an energy store is provided which is part of the latching connection and keeps the oil cooler pretensioned in a defined desired position. The energy store is in particular a spring store which is formed from a material tongue which is formed on the latching receiving element and, when the oil cooler in introduced into the latching receiving element, is correspondingly pretensioned. The use of the spring store keeps the oil cooler in a defined position in particular in the introductory direction of the oil cooler into the oil cooler receiving element. The play which is required in order to produce the latching connection or clip connection is eliminated by the pretensioning of the spring store. The spring store opposes in particular the acceleration forces and approach flow forces acting on the oil cooler. In addition, it is advantageous if the spring store is additionally divided in a dovetailed manner in the direction of action of the spring store and an alignment of the oil cooler in a further direction in the oil cooler receiving element is thereby made possible. This preferably takes place by a corresponding shaped section, such as a functional element of the oil cooler, for example a housing section of the oil cooler, penetrating the opening of the dovetail and being centered by the two flanks. The bearing of the dovetail against the corresponding element of the oil cooler is likewise achieved by the spring action. The two bearing points on the flanks and the support on the latch then ideally form a three-point support which makes a particularly well defined retention of the oil cooler possible.

According to a preferred refinement of the fastening means, the oil cooler receiving element is of U-shaped design. In this case, a respective latching connection is preferably provided on both limbs of the U-shape and is used to produce an engagement between oil cooler receiving element and oil cooler. In this case, provision can be made for the oil cooler receiving element to be of such elastic design that, when the oil cooler is introduced into the oil cooler receiving element, the limbs of the U-shape spread out, with this elastic spreading-out being at least partially reversed during the latching of the latching connection.

The limbs of an oil cooler receiving element of U-shaped design are preferably spaced apart vertically from each other in the installation position of the oil cooler receiving element and aligned in the transverse direction of the vehicle. This corresponds to a design in which the limbs of the U-shaped receiving element engage over or under the oil cooler and the oil cooler is arranged in a horizontal alignment in the vehicle transversely with respect to the direction of travel. In this case, the arrangement of the oil cooler can be provided below and in front of or behind another cooler.

According to a further refinement of the invention, the oil cooler receiving element is fixed at least indirectly on the vehicle, with the fixings of the oil cooler receiving element preferably being adjustable in position, for which purpose, in particular, elongated holes are provided.

Otherwise, the invention is explained in more detail with reference to the exemplary embodiment illustrated in the drawing, in which.

Figure 3A:
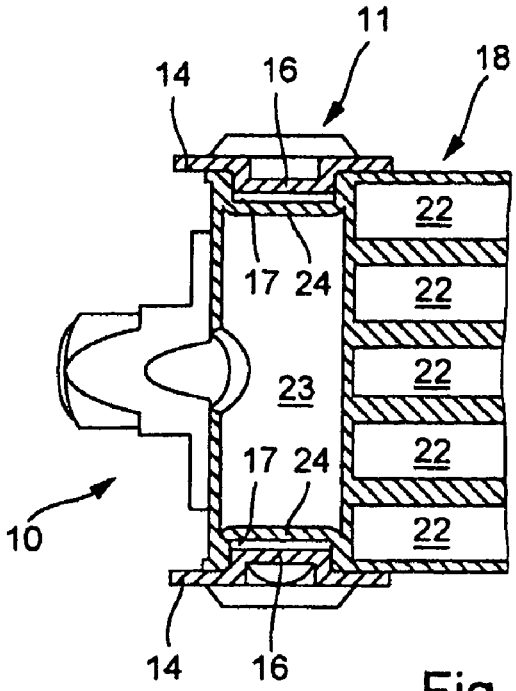
Figure 3B:
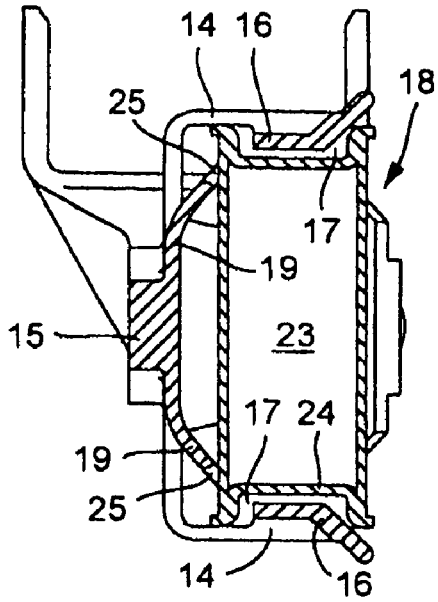
Figure 4:
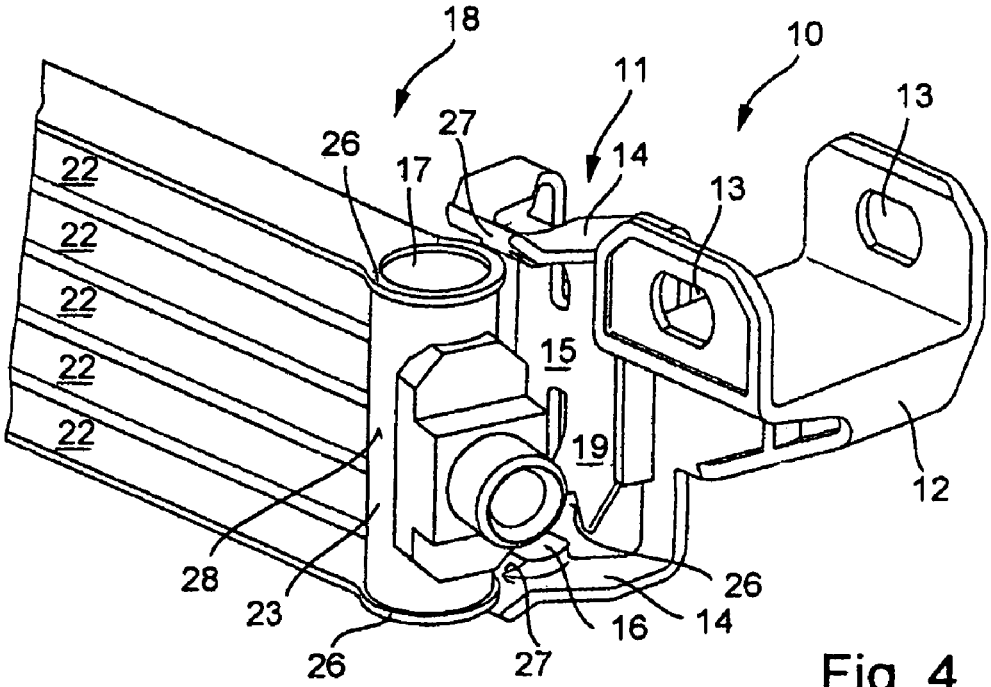

FIGS. 3*a*, 3*b* show, in different sectional illustrations, the mounting of the oil cooler in the oil cooler receiving element; and FIG. 4 shows, in a three-dimensional illustration, the introduction of an oil cooler into the oil cooler receiving element.

Figure 1:
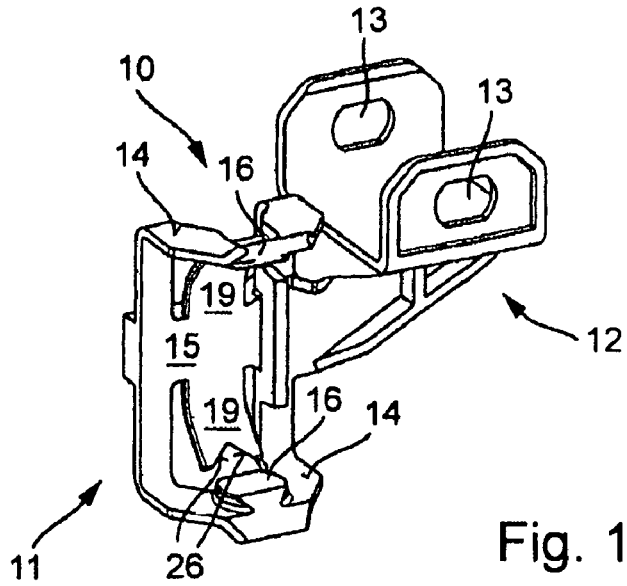
FIG. 1 shows the perspective view of an oil cooler receiving element.

FIG. 1 shows an oil cooler receiving element 10 in a perspective illustration. The oil cooler receiving element comprises a U-shaped receiving region 11 and a basic body 12. The basic body 12 has fixings 13 which are in each case designed as an elongated hole and are used for the at least indirect fixing of the oil cooler on the vehicle side.

The receiving element 11 is of U-shaped design and comprises two limbs 14, which are aligned parallel to each other and are spaced apart vertically from each other, and a back web 15 which connects the two limbs 14 to each other. Each of the two limbs 14 has a latching lug 16 which is used for latching into a latching depression 17 of the oil cooler. An interlocking bearing at least in some sections is produced in this case. It is also possible for the latching lug 16 to engage behind a shaped section of the latching depression 17, with the result that in addition to the interlocking connection there can also be a frictional connection. The latching of the latching lug 16 in the latching depression 17 of the two limbs 14 enables an oil cooler 18 to be securely fixed in the oil cooler receiving element 10.

The back web 15 has integrally formed material tongues 19 which are bent away in such a manner that they project into the introductory space of the oil cooler 18 between the two limbs 14 of the oil cooler receiving element 10. Owing to the inherent elasticity of the material used, the material tongues 19 are used as spring leaves of a spring store. The material tongues 19 are divided here at their free ends in a dovetailed manner, with the V-shaped inner sides forming flanks 25 which serve for the centering reception of the oil cooler.

Figure 2:
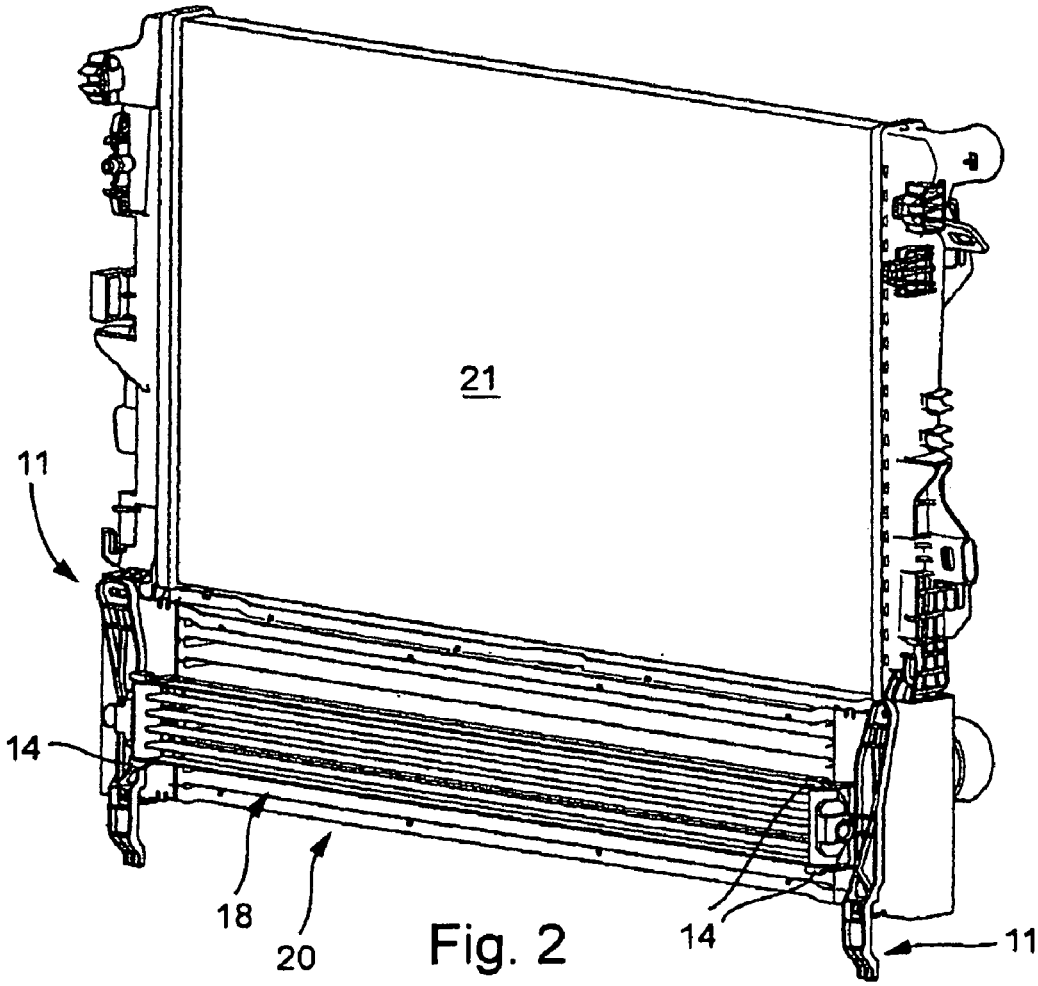
FIG. 2 shows an oil cooler held on a further cooler by means of an oil cooler receiving element.

FIG. 2 shows, in a three-dimensional, perspective illustration, the arrangement of an oil cooler 18 in a region behind an additional cooler 20 which is arranged below the main cooler 21. For this purpose, a respective receiving element 11 is fixed to the additional cooler 20 or to the mount thereof on both sides of the extent of the oil cooler in the transverse direction of the vehicle. The oil cooler 18 is held between the limbs 14 of the oil cooler receiving element 10. In this case, the oil cooler extends parallel to the further coolers in the transverse direction of the vehicle, with the figure illustrating a view which shows the direction of observation in the direction of travel from a point behind the arrangement of the coolers in the vehicle. In the approach-flow direction of the air flow flowing through the cooler, the oil cooler 18 is therefore situated behind the additional cooler 20, which may be, for example, the cooler of an air conditioning system.

FIGS. 3*a* and 3*b* show sectional illustrations in different sectional directions through an oil cooler and an oil cooler receiving element. The section of FIG. 3*a* makes it possible to see, in a particularly favorable manner, how the of the two limbs 14 of the receiving element 11 of the oil cooler receiving element 10 the latching lugs 16 engage in the latching depressions 17 of the oil cooler. In this case, the latching depressions are formed in a with respect to the extent of the cooling lines 22, through which the gear oil flows, of the vertically aligned distributor channel 23. The distributor channel 23 essentially has a cylindrical basic shape and the latching depression 17 is formed by the cover 24 closing the distributor channel 23 being set back axially in the direction of extent in relation to the terminating edge. In addition, corresponding latching of the diameter and of the shape of the latching lug 16 of the limbs 14 makes it possible for a corresponding centering effect for the oil cooler in the fixing to be achieved. By simultaneous engagement at the two mutually opposite ends of the distributor channel, a centering and fixing of the position of the oil cooler 18 in the receiving element 11 and therefore in the oil cooler receiving element 10 is achieved.

As can be seen in particular from FIG. 3*b*, the centering effect in the introductory direction can be further increased by the material tongues 19 acting as spring elements. The back web 15, which connects the two limbs 14 to each other, has material tongues 19 which project into the introductory space of the oil cooler 18, are divided in a dovetailed manner, act as a spring store and, owing to the bearing of the flanks 25, bear against the vertical channel 23 of the oil cooler and act upon the latter in the removal direction from the receiving element 11. On the one hand, this serves to secure the latching connection because an interlocking connection can then be produced between latching lug 16 and latching depression 17 in a particularly favorable manner, and, secondly, the oil cooler receiving element supports the oil cooler even in relation to forces running in the direction of travel, such as acceleration and deceleration forces.

FIG. 4 shows the introductory operation of an oil cooler 18 with a distributor channel 23 and cooling lines 22 into an oil cooler receiving element 10. The oil cooler receiving element has a basic body 12 which has fixing means 13, such as elongated holes, so that the oil cooler receiving element can be secured at least indirectly on the vehicle frame. In order to hold the oil cooler, the oil cooler receiving element 10 has a receiving element 11 which is of U-shaped design. The two limbs 14 protrude horizontally, parallel to each other and aligned in the direction of travel from a back web 15. The back web 15 has the material tongues, which are divided in a dovetailed manner, as spring store. When the oil cooler is introduced, in particular the distributor channel 23 projecting into the region of the receiving element 11, the limbs 14 are first of all spread out elastically. The edge 26 of the distributor channel 23 comes into contact with the introductory slope 27 of the latching lug 16. The limbs 14 are spread out to such an extent that the latching lugs 16 can slide over the edge 26 and then the latching lugs 16 can drop into the latching depression 17 on the distributor channel 23. At the same time, the wall 28 of the distributor channel 23 comes into contact with the edges 26 of the dovetailed division of the material tongues 19 and presses the material tongues 19 out of their rest position into a pretensioned end position, from which they produce an interlocking bearing of the latching lug 16 in the latching depression 17 and cushion the oil cooler against being deflected out of this position in the introductory direction, i.e. direction of travel of the vehicle or in the opposite direction. These are in particular effective acceleration and deceleration forces from the driving mode. The oil cooler receiving element here is preferably produced from plastic, which firstly permits a low weight and secondly an adjusted plastic deformability with sufficient material stiffness.

The invention claimed is:

1. A fixing device for an oil cooler in a vehicle, comprising:

an oil cooler fixed in an oil cooler receiving element, wherein there is a latching connection between the oil cooler receiving element and the oil cooler, wherein the oil cooler receiving element is of U-shaped design, with the respective latching connection being formed on both limbs of the U-shape, the latching connection centers and fixes the oil cooler in the oil cooler receiving element, and oil cooler is kept pretensioned in a desired position by an energy store, wherein the energy store is a spring store formed by at least one material tongue which is formed on the oil cooler receiving element, wherein the at least one material tongue projects from the oil cooler receiving element, wherein the at least one material tongue contacts the oil cooler to center the oil cooler in the oil cooler receiving element.

2. The fixing device as claimed in claim 1, wherein the latching connection comprises a latching connection element on a side of the oil cooler receiving element and engages in a latching receiving element on the side of the oil cooler.

3. The fixing device as claimed in claim 2, the latching connection element and the latching receiving element form a clip connection, the clip connection being releasable in particular in a non-destructive manner.

4. The fixing device as claimed in claim 1, wherein the energy store is divided in a dovetailed manner for additional alignment in a further direction.

5. The fixing device as claimed in claim 1, wherein the introduction of the oil cooler into the oil cooler receiving element results in the limbs of the U-shape spreading out, which is at least reduced with production of the latching connection.

6. The fixing device as claimed in claim 5, wherein the limbs each comprise a latching lug and the oil cooler comprises a latching depression, and wherein the limbs are spread to allow the latching lugs to slide over and drop into the latching depression resulting in an interlocking bearing of the latching lug in the latching depression.

7. The fixing device as claimed in claim 6, wherein the oil cooler includes a manifold with ends located at each end of a longitudinal axis of the oil cooler manifold, wherein a latching depression is located at each end of the oil cooler manifold.

8. The fixing device as claimed in claim 1, wherein, in the installation position of the oil cooler receiving element, the limbs are spaced apart vertically from one another and are preferably aligned in the longitudinal direction of the vehicle.

9. The fixing device as claimed in claim 1, wherein the oil cooler receiving element is fixed on a vehicle side, with the fixing device preferably being adjustable in position.

10. The fixing device as claimed in claim 1, wherein the oil cooler receiving element is made of plastic.

11. The fixing device as claimed in claim 1, wherein the at least one material tongue forms a first surface of the oil cooler receiving element, wherein the latching connection forms at least a second surface of the oil cooler receiving element, wherein the first and the second surfaces are different surfaces.

12. The fixing device as claimed in claim 11, wherein the oil cooler includes a manifold, wherein the at least one material tongue contacts a side of the oil cooler and the latching connection is formed at each end of a longitudinal axis of the oil cooler manifold.

13. The fixing device as claimed in claim 1, wherein the oil cooler receiving element includes two material tongues.

14. The fixing device as claimed in claim 1, wherein the U-shape includes a web extending between the limbs, wherein the at least one material tongue projects from the web to contact the oil cooler.

15. The fixing device as claimed in claim 1, wherein the oil cooler includes a manifold with ends located at each end of a longitudinal axis of the oil cooler manifold, wherein each latching connection engages with the ends of the oil cooler manifold.

16. The fixing device as claimed in claim 1, wherein the oil cooler includes a manifold, wherein the limbs of the U-shape engage with ends of the manifold located at each end of a longitudinal axis of the oil cooler manifold such that the longitudinal axis of the oil cooler manifold extends between the limbs.

* * * * *